United States Patent [19]

Faulin

[11] 4,353,574

[45] Oct. 12, 1982

[54] SKI BINDING STRUCTURE

[76] Inventor: Antonio Faulin, Via G. da Procida 4, Milano, Italy

[21] Appl. No.: 118,377

[22] Filed: Feb. 4, 1980

[30] Foreign Application Priority Data

Feb. 16, 1979 [IT] Italy ..... 20285 A/79
Aug. 8, 1979 [IT] Italy ..... 24981 A/79

[51] Int. Cl.[3] ..... A63C 9/08
[52] U.S. Cl. ..... 280/613; 280/11.36
[58] Field of Search ..... 280/11.36, 634, 623, 280/617, 618, 613, 633

[56] References Cited

U.S. PATENT DOCUMENTS

| | | | |
|---|---|---|---|
| 4,058,326 | 11/1977 | Faulin | 280/617 |
| 4,081,186 | 3/1978 | Beyl | 280/618 |
| 4,098,522 | 7/1978 | Beyl | 280/618 |
| 4,168,085 | 9/1979 | Faulin | 280/618 |
| 4,264,088 | 4/1981 | Replogle | 280/618 X |

*Primary Examiner*—Joseph F. Peters, Jr.
*Assistant Examiner*—Michael Mar
*Attorney, Agent, or Firm*—Guido Modiano; Albert Josif

[57] ABSTRACT

There is described a ski binding structure of the type having a substantially rigid rod-like element pivotally connectable to the ski about an axis substantially parallel to the plane of the ski and substantially perpendicular to the longitudinal extension of the ski. The rod-like element is urged against the skier's leg and has a free end bent substantially in form of a U to define lateral engagement with the skier's leg. There is further provided a front latching body fixable on the ski and capable of removably engaging with a peg provided in the sole of the skier's footwear, and a rear latching body fixable on the ski and having a pressure element resiliently urged in a shaped seat of the rear portion of the skier's footwear.

10 Claims, 27 Drawing Figures

Fig. 12
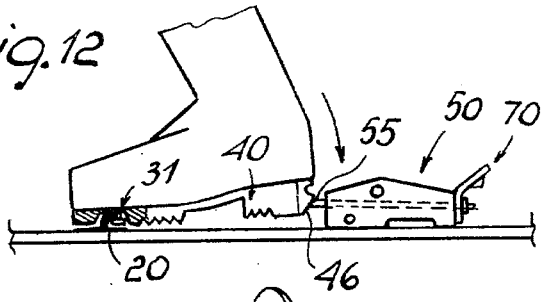
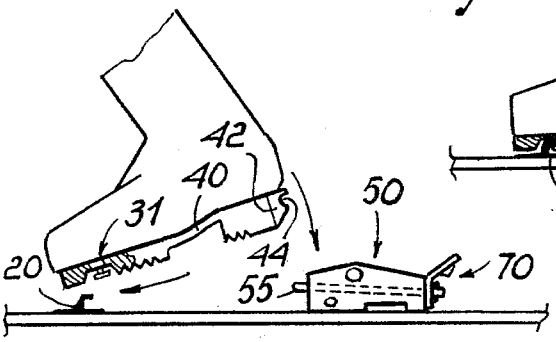
Fig. 11
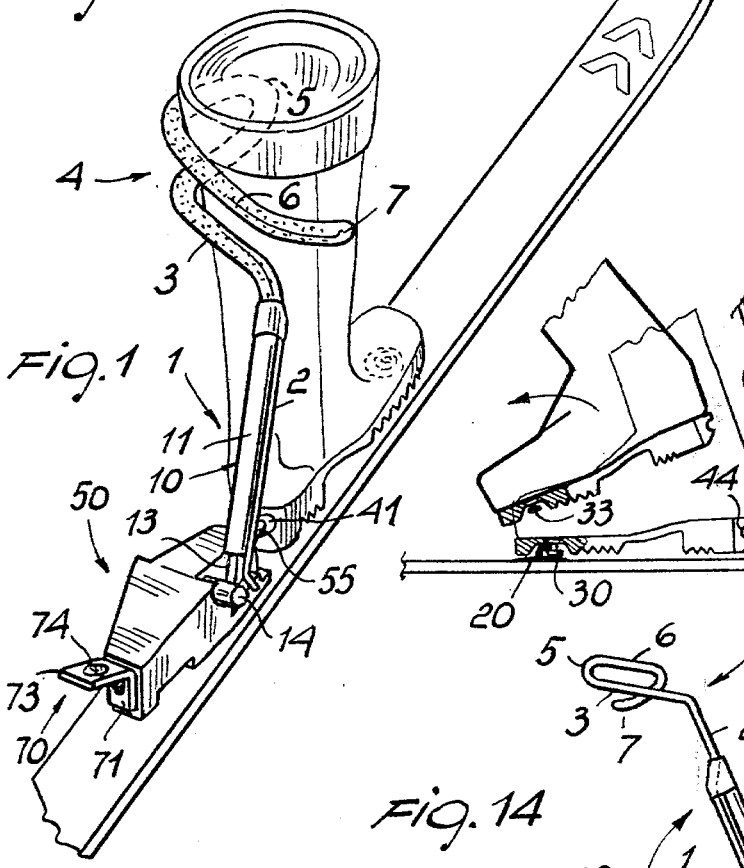
Fig. 1
Fig. 13
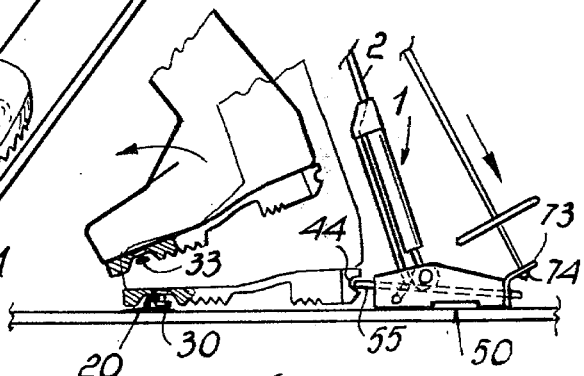
Fig. 14
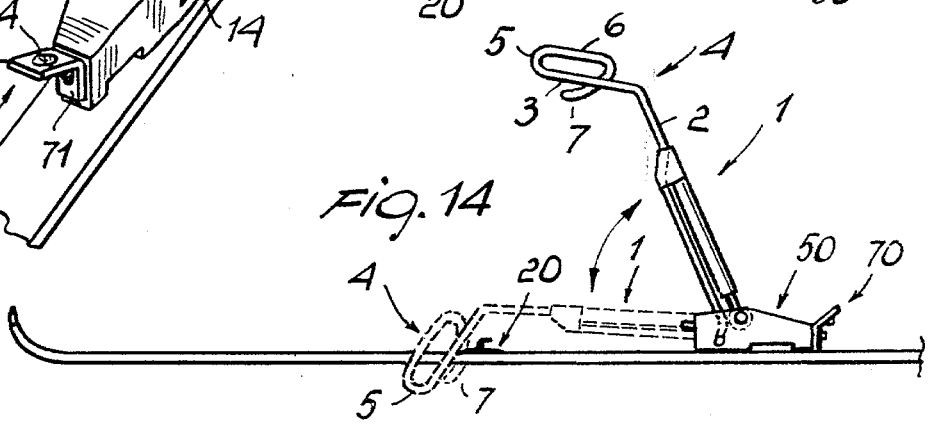

SKI BINDING STRUCTURE

BACKGROUND OF THE INVENTION

This invention relates to a ski binding structure.

U.S. Pat. Nos. 4,058,326 and 4,168,085 by the same Applicant disclose ski bindings which have a lever journalled or pivotally connected to the ski along an axis which extends substantially parallel to the plane of the ski and perpendicular to the ski longitudinal direction, the lever being shaped for engaging the skier's leg at the tibia level. These bindings, which also comprise means for releasing the ski, allow their user to wear a soft type of footwear, while ensuring adequate protection for the skier's leg and permitting in use the so-called "edging".

The ski bindings mentioned above, while effective from a functional standpoint, have revealed in some cases that their construction is relatively complicated and accordingly expensive to produce.

SUMMARY OF THE INVENTION

This invention sets out to improve the ski bindings of the type mentioned above by providing a ski binding structure which, while retaining the functional characteristics unaltered, is simplified construction-wise and advantageous both for the user and the manufacturing procedure.

Within that general aim, it is a particular object of this invention to provide a ski binding structure which is practically free from malfunctions and the possibility of jamming, as well as most safe and reliable in use.

It is a further object of this invention to provide a ski binding structure which affords a considerable reduction in size, primarily in height (i.e. in a direction perpendicular to the plane of the ski), over bindings of known design, whether of the lever type, as cited in the preamble, or of any other conventional type making no use of such a lever.

A not unimportant object of the invention is to provide a ski binding structure, wherein the size of the components is extremely compact and the binding is enabled to operate as a ski locking device without requiring such attachments as straps, snap elements, or the like.

These and other objects, such as will be apparent hereinafter, are achieved by a ski binding structure according to the invention which comprises a substantially rigid rod-like element, said rod-like element being associable at one end thereof with a ski with provision for rotation about an axis extending substantially parallel to the plane defined by said ski and substantially perpendicular to the ski longitudinal extension, and at the other end, engageable with a skier's leg at a middle portion of said leg, elastic means being arranged to act on said rod-like element to maintain said rod-like element in contact with the skier's leg, the structure being characterized in that it further comprises a front latching body, adapted for attachment to the ski and detachably engageable with a peg provided on the sole of the skier's footwear, in the region of the sole of the foot, and a rear latching body, adapted for attachment to the ski and having a pressure element elastically and detachably engageable with a rear groove provided at the rear portion of said footwear.

BRIEF DESCRIPTION OF THE DRAWINGS

Further features and advantages will be more clearly understood from the description of some preferred embodiments of a ski binding structure according to the invention, as illustrated by way of example only in the accompanying drawings, where:

FIG. 1 is a schematical perspective view of a binding structure as applied to a ski, according to a first embodiment of the invention;

FIGS. 11 and 12 illustrate schematically the step of securing the footwear to the binding structure of this invention;

FIG. 13 illustrates schematically the step of releasing the footwear from the ski binding structure;

FIG. 14 shows schematically the binding structure in its operative position, and in dotted lines, in its rest or inoperative position;

DESCRIPTION OF THE PREFERRED EMBODIMENTS

Figures 2, 3, 4, 7, 8:
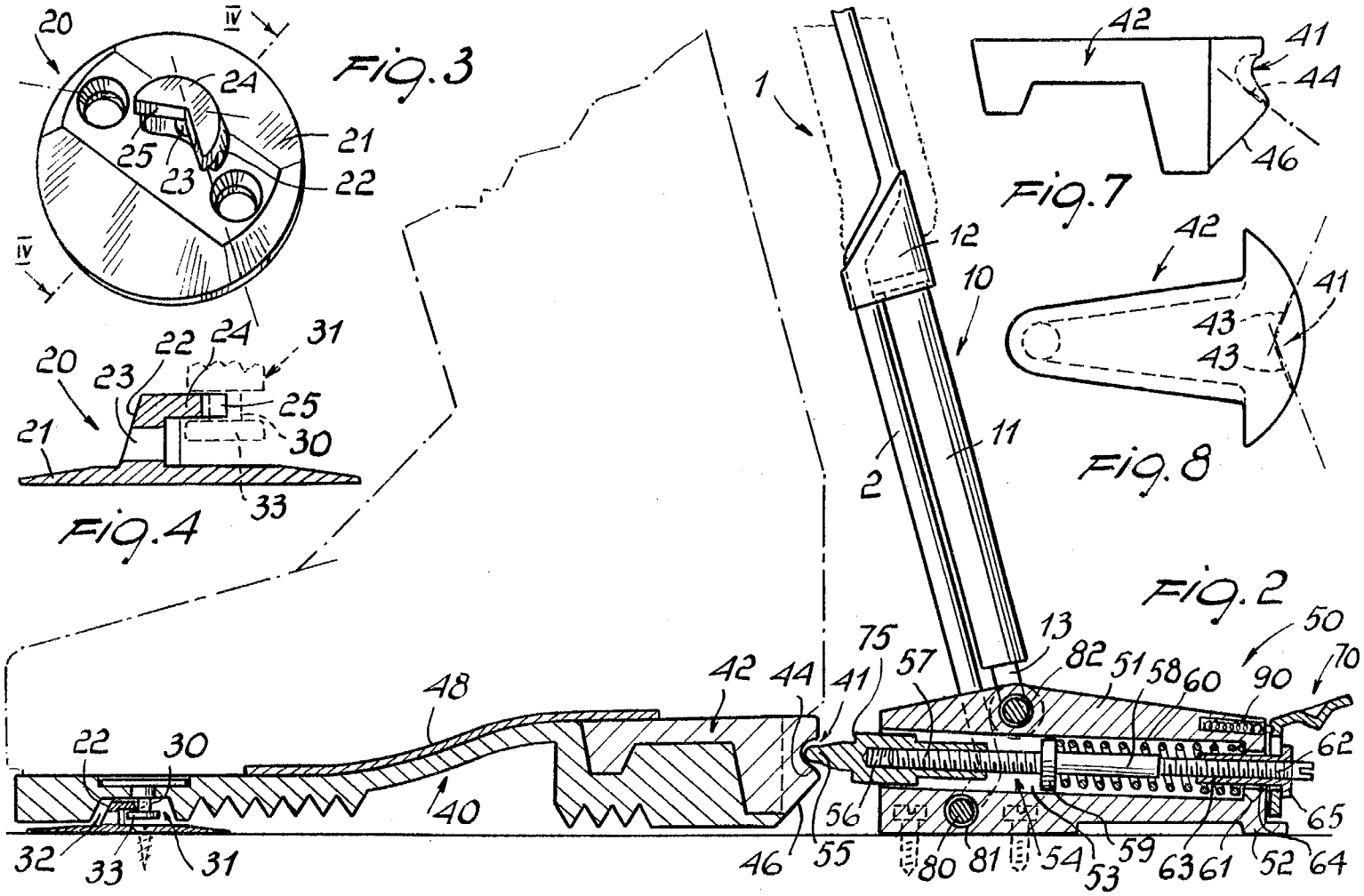
FIG. 2 is a longitudinal section of that same binding structure.
FIG. 3 is a perspective view of the front latching body.
FIG. 4 is a sectional view taken along the line IV—IV of FIG. 3, the front latching element of the footwear sole being shown in dotted lines.
FIG. 7 is an elevational detail view of the footwear rear portion.
FIG. 8 is a detail view similar to FIG. 7, as viewed from above.
Figure 5:
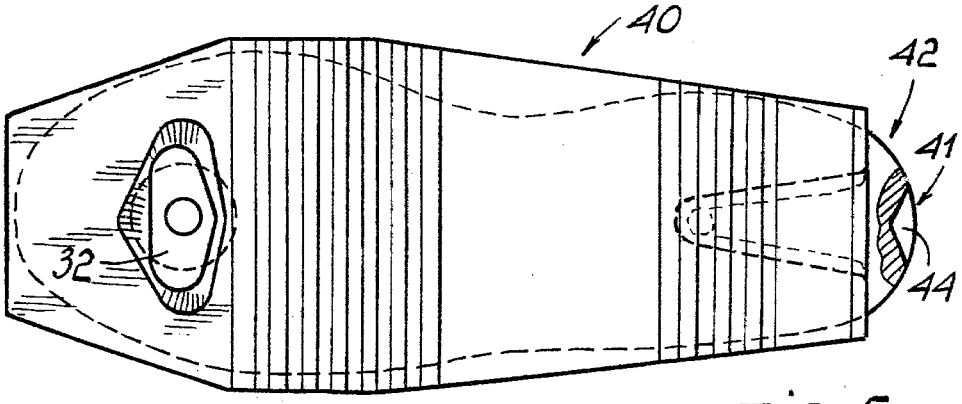
FIG. 5 is a bottom plan view of the footwear sole, prior to the shaping thereof.
Figure 6:
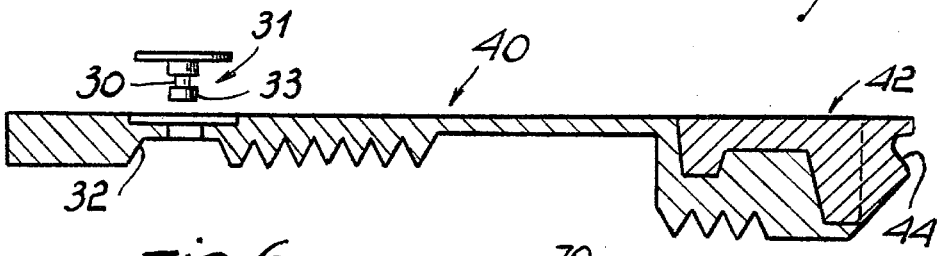
FIG. 6 is a longitudinal sectional view of the footwear sole, prior to the shaping thereof.
Figure 9:
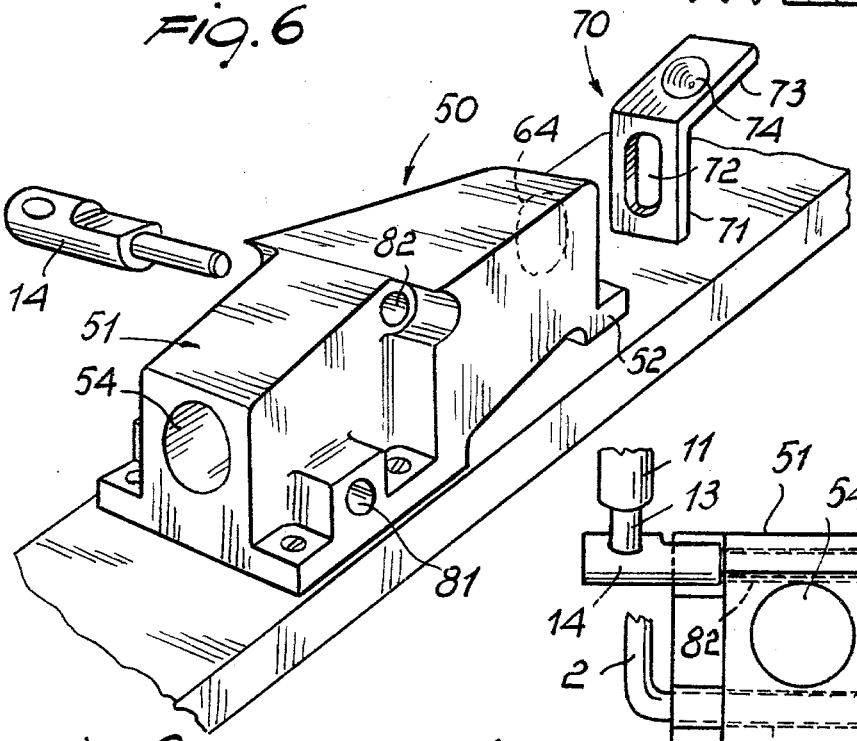
FIG. 9 is a perspective, partly exploded, view of the rear latching body.
Figure 10:
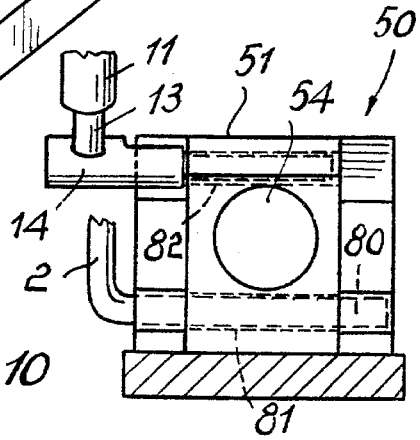
FIG. 10 shows schematically a front view of the rear latching body.

With reference initially to FIGS. 1–14, the ski binding structure comprises a substantially rigid rod-like element 1, which is associated at its bottom or lower end with the ski, with provision for rotation about an axis extending substantially parallel to the plane defined by the ski and perpendicular to the longitudinal extension of the ski.

The cited rod-like element 1 may be directly associated with the ski or possibly associated with a body which is rigidly connected to the ski, like in the example illustrated in the drawings and explained hereinafter.

Said rod-like element 1 has a rectilinear portion 2 which, at its free top end, has an upward sloping portion 3 which connects to a coupling body 4, which is enabled to contact engage a rear and side region of the skier's leg, at the height of a middle portion of the tibia. Said body 4 is preferably formed with a U-like portion or section 5 which, through a transversal portion 6, is connected to a terminating portion 7, opposite the U-like portion 5. Advantageously, the portion 7 is spaced apart from the portion 4 by a distance exceeding the ski width dimension.

This allows, when in the inoperative position or in the event of the ski incidentally coming loose from the skier's leg, the cited portions 5 and 7 to protrude sideways from the ski and have their ends positioned at a lower level than the ski sole, thereby they function in practice as ski stoppers (position shown in dotted lines in FIG. 14).

Furthermore, the binding structure comprises resilient means arranged to act on said rod-like element and hold it in constant contact with the rear region of the skier's leg, said means being preferably composed of a gas spring, of a type readily available on the market, which is indicated at 10 and has a cylinder 11 which is secured, with slight backlash or play, in a seat provided in a shaped block 12 attached to the rod-like element 1 in the region of the rectilinear portion 2, and further has a piston 13 the end whereof is secured, with allowance for play, around a crosspin 14 carried by the ski, or more precisely, by the rear latching body thereof, as will be explained more clearly hereinafter. It should be noted here that the elastic means, which perform the rotation of the rod-like element 1, can obviously be of any desired type, such as a pressure spring or a pin spring set for acting at the rotation axis of the rod-like element 1, with the optional assistance of a shock-absorbing element.

The ski binding structure further comprises a front latching body, generally indicated at 20 in FIGS. 1–14, which includes a plate 21 adapted to be fastened, by means of screws, directly onto the ski and having a supporting upright 22 which extends upwardly and is formed with a central hole 23 for discharging any snow build-up; said upright 22 carries a small latching plate 24 which protrudes with respect to the upright 22, towards the rear portion of the binding and defines at its edge a front latching socket 25 of substantially V-like configuration which opens to the rear portion of the binding; the inclination of the two sides or limbs of the socket is related, in a manner that will be explained hereinafter, to the magnitude of the automatic release force to be attained in the binding.

Said socket receives in contact relationship the stem 30 of a peg 31 provided in a shaped recess 32 which is defined in the sole 40 of the skier's footwear at the planta. The peg 31 is also provided with an enlarged head 33 which, being accommodated below the underside of the front latching plate 24, prevents the peg 31 from incidentally moving out of the front latch body 20 as long as the sole is held urged forwardly with a predetermined force. As visible from FIG. 2, the front latching body 20 has a height that in greater than the depth of the recess 32 so that the sole of the skier's footwear remains spaced from the ski.

The ski binding structure further comprises a rear latch body, generally indicated at 50 in FIGS. 1–14, which, in turn, comprises an outer enclosure or casing 51, preferably formed from a plastics material such as nylon, which is secured at its front portion by means of screws which fasten it firmly to the ski, and is formed with a rear lug or appendage 52 caused to bear on the ski with its free end at a point spaced from the area where the screws are mounted, for reasons which will be apparent hereinafter.

Said casing 51 has on its inside a passage or through seat 53 accommodating a pressure element or plunger, generally indicated at 54.

Said pressure element 54 is provided with a tip or nose member 55 which protrudes forwardly out of the seat 53 and defines on its inside a threaded axial socket 56 wherein a threaded shank 57 engages pivotally which constitutes the front end of the stem 58 of the pressure element 54. On said stem 58, on the same side as said threaded shank 57, there is provided an annular widening 59 on which a coil spring 60 is active which acts with its other end against abutment detents 61 defined in said passage or through seat 53, at the rear end of the casing 51. At its rear end, the stem 58 has a threaded shank 62 which engages pivotally a bushing 63 carried for axial sliding movement in a through opening 64 defined at said detents; said bushing 63 has of preference an oval outer surface mating with the shape of the opening 64, thereby rotation of the bushing about its own axis is effectively prevented, while permitting a sliding movement in a longitudinal direction with respect to the axis of the stem 58 and of the bushing itself.

Said bushing 63 defines, at its end protruding out of the casing 51, a flange 65 which engages by contact with an angle plate 70, the lower flange 71 whereof has a cutout or window 72 wherethrough the bushing 63 is inserted such that the flange 65 holds the lower flange 71 pressed elastically against the rear portion of the casing 51; moreover, from the lower flange 71 there extends upwardly an upper flange 73 having a notch 74 for engagement with the tip of a stick, as will be explained hereinafter, to accomplish a quick release of the rear latch.

The cited tip or nose 55 is in contact engagement with a rear latching notch or groove 41, which is formed in an insert 42 which can be inserted into the heel portion of the sole 40. The rear latching notch 41 has advantageously a pair of side inclines 43 allowing sideway release, and a lower incline 44 allowing release in an upward direction. Naturally, it is also possible to provide two substantially converging inclines, an upper one and a lower one, in addition to the two side inclines.

The insert 42 is further provided with a lower lead-in chamfer 46 which facilitates the insertion of the nose 55 into the notch or seat 41 when the footwear is connected to the ski, or more precisely, to the front latching body and rear latching body.

Thus, it will be appreciated that the nose 55 applies an axial compression force to the sole, which remains locked by the front latching body 20; to avoid unwanted flexing of the sole, a substantially rigid reinforcement 48 is provided which spans the sole mainly at the heel and hollow regions, to leave the front portion of the sole underside unaltered, thereby the sole is allowed to flex in walking. This flexibility may also be useful for releasing the footwear from the ski.

The ski binding structure according to the invention is used as follows. Initially, the position of the nose 55 is adjusted, inasmuch as it is necessary to determine, according to the footwear worn, the distance from the nose 55 to the location of the front latching body 20. To this aim, the nose has on its portion protruding out of the casing 51 cutouts 75 intended for engagement by a wrench or similar tool and permitting the nose itself to be rotated with respect to the threaded shank 57, thereby determining its exact position in an axial direction, as well as accommodating any slight errors in the mounting of the front latching or locking body 20 and rear latching or locking body 50 and any variations in length of the footwear, limited to the front and rear latches.

It should be further added that, advantageously, there is provided in the threaded socket 56 an insert of a plastics material which prevents all chances of an incidental or free rotation of the nose 55 with respect to the threaded shank 57; obviously, other similar means may be utilized to prevent such an incidental rotational movement.

The user will also calibrate the release force of the binding by varying the compression of the coil spring 60. For this purpose, it will be sufficient for the user to rotate, while holding the nose 55 locked to prevent it from changing its position, the threaded shank 62, which travels axially by engagement with the bushing 63 to vary the distance between the annular enlargement 59 and the detents 61 and, accordingly, vary the action of pre-compression on the spring 60.

It should be noted that, quite intentionally, to calibrate the spring 60, which is in practice a calibrating operation of the binding automatic release force, it is necessary to use two tools, one for locking the nose 55 and the other to rotate the threaded shank; this is so as to prevent the user from effecting the calibration of the release force in an excessively careless manner, with attendant potential danger if said release force has too high a value.

To insert the footwear into the binding, after the desired adjustments of the rear latching or locking body 50 have been completed, the shaped plate 24 is first inserted into the notch 32 formed under the sole 40 at the planta. It should be noted that, owing to the peculiar shape of the plate 24, any snow build-up in the notch would be automatically ejected, then the operator practically inserts the shank 30 of the peg 31 into the V-like socket 25.

It should be noted here that the front latch is coupled to the shank 30 rather than to the enlargement 33, because it is possible for the head, inasmuch as it is facing the underside of the sole, to become damaged or otherwise deteriorated during the skier's walking; the shank 30 is instead adequately protected and a reliable connection can be always maintained between the socket or seat 25 and shank 30.

Once the user has inserted the peg 31 into the front latching body, by forcing the heel portion of the footwear against the nose 55 he causes it in practice to move rearwardly against the bias of the coil spring 60 until the nose enters the seat 41. For this purpose, to facilitate the latching operation, the chamfer 46 is provided which contributes to facilitating the insertion.

Thus, the footwear is retained on the ski through the pressure action exerted by the nose 55 of the pressure element against the heel of the footwear, in abutment relationship with the fixed portion constituted by the front latching body; the two elements, that is the front latching body and the nose are arranged such that in normal rest conditions the footwear sole does not bear on the ski but is raised, albeit minimally, from the ski to avoid any frictional interaction between the sole and ski which might make the release operation ineffective. As visible in FIG. 2, the pressure element or plunger 54 may be inclined upwards to provide a force component acting against the weight force of the skier. The rod-like element 1, in normal operation conditions, is arranged such that the upper shaped body encircles the rear portion of the skier's leg at the calf region, it being urged against the leg by the cited gas spring which provides, in practice, a forwardly directed push while the side elements hinder any relative sideway movements of the ski and tibia.

It should be pointed out here that the rod-like element 1 is advantageously supported by the same rear latching body 50, in that it has a first crosspin 80 inserted through a transversal seat 81 formed in the latching body, the piston 11 of the gas spring 10 being connected to a second crosspin 14, also pivotally receivable in a second transversal seat 82 provided in the body 50.

The mutual arrangement of the two elements is such that the lower portion of the rod-like element 1, in the event of forced movement or rearward rotation, strikes the cited crosspin 14, which acts in practice as a locking member against rearward rotation, without the rod-like element striking with its rectilinear portion 2 the body of the gas spring 10, which being generally made of aluminum could be damaged by the pressure applied thereto by the rod-like element.

The safety afforded by the binding system in normal operating conditions results from the rod-like element 1 engaging with a middle portion of the skier's leg to provide adequate protection of the leg articulation and relieving the binding system of that function. Furthermore, in the event of dangerous stresses occurring, the footwear is automatically released from the binding. In fact, in the case of the foot being twisted in one or the other direction with respect to the leg, sideway release will occur because both the peg 31 and nose 55 engage with the inclined portions provided in the respective seats, to thus permit the release action.

Moreover, in the event of an excessive upwardly directed pull being applied, i.e., for example, in the event of the skier falling forward on his/her face, the nose 55 will engage the lower incline 44 provided on the rear seat 41, thus allowing the nose to disengage itself from the seat 41, with resultant release of the ski.

By contrast, in the event of the skier falling to the rear, or when an effort is applied in the direction of the rear portion, above a level which can be considered potentially dangerous, thanks to the degree of flexibility imparted to the sole, the sole itself will tend to bow and raise its central portion, while the toe end slopes downwardly; this causes the peg 31 to also take an inclination such that the front release plate 24 is in practice engaged by an incline formed by the head 33 of the peg 31, which is now inclined, to facilitate the release of the peg 31 from the front portion.

It should be pointed out that, in the event of a rearwardly directed effort, i.e. of a push from the rear, the rod-like element 1, being urged vigorously rearwardly, applies a considerable moment to the rear locking body affixed to the ski; the body, as indicated, has an elongated shape and engages by contact at its rear lug with the ski at a point remotely located from the area of application of the screws which fasten the body to the ski. This results, in the event of an effort and owing to the resisting arm being in practice lengthened, in the resisting force which acts on the screws being correspondingly reduced such as to prevent the screws from being pulled out of the ski and break; moreover, a certain deformability inherent to the material from which the rear body is formed introduces a slight degree of elastic deformation, thereby it may be said that in practice the four screws which secure the rear body are all subjected to a similar force, with attendant improved distribution of the loads and increased strength.

In order to release the footwear from the binding, it will be sufficient to apply, e.g. through the tip of the ski stick, a force to the upper flange 73 of the angle plate 70, which exerts a rearward pull on the stem 58, thus overcoming the elastic action of the spring 60 and causing the nose 55 to move to the rear and release the footwear.

For completeness sake, it should be further added that a compression spring, indicated at 90, is advantageously provided which acts between a point on the lower flange 71 and the upper or top portion of the rear locking body 50 to prevent the plate itself from undergoing vibration or effecting unwanted movements.

In the embodiment illustrated in FIGS. 15–27, the ski binding structure comprises a pair of supports 101 which are spaced apart from each other and can be attached to the side edges of a ski 102; that pair of supports define a pair of holes 103 which are aligned to each other and substantially parallel to the plane defined by the ski and perpendicular to the longitudinal extension of the ski, for pivotal engagement with the lower end of the rod-like element 104, which end is bent substantially to right angles with respect to the extension of the rod-like element 104.

To prevent the lower end of said rod-like element 104 from sliding out of the supports 101, there is provided at the lower free end of the rod-like element 104, an annular groove 105 wherewith a Bensing type of washer 106 engages which is accommodated in a side cutout 107 defined in the supports 101.

With the lower or bottom end of the rod-like element 104, at the area included between the cited support pair 101, there engages pivotally the front portion of the rear latching body 110, which comprises an elongated block 111, defining at the lower front a transversal seat 112, wherein there engages the rod-like element 104, the resting at the rear onto the ski in a manner which will be described hereinafter. Thus, the rear latching body 110 is journalled to the supports 101 about an axis which is coincident with the rotation axis of the rod-like element 104.

Said rear block 111 has on its inside a through seat 113 for accommodating a pressure element or plunger 114, like in the embodiment of FIGS. 1–14.

The pressure element 114 is largely similar to the pressure element 54 and is preferably inclined like the latter and comprises a nose or tip 115, a threaded axial recess 116 in the nose 115, a threaded stem 117 in the recess 116, a stem 118 with an annular enlargement 119, a coil spring 120 between the enlargement 119 and abutment detents 121, a threaded shank 122 on the stem 118, and a rear bushing 123 on the shank 122. The bushing 123 is passed through an opening 124 defined by the detents 121, the arrangement being such, in this embodiment as well, as to hinder the rotation of the bushing about its own axis, while permitting a sliding movement in a longitudinal direction with respect to the axis of the stem 118 and bushing.

In addition, there is provided a flange 125 which engages by contact an angle plate 126 having a window or cutout 127 wherethrough the bushing 123 is inserted, the lower flange 128 of the plate 126 being pressed against the rear portion of the body 111 and the upper flange 129 having a depression for engagement with the tip of a ski stick, like in the embodiment of FIGS. 1–14. The nose 115 has cutouts 130 for engagement by a wrench or the like tool for adjustment purposes.

To prevent inadverted rotation of the nose 115, there is provided in the axial threaded recess 116 a small piston 131 which also extends into a corresponding recess 132 provided in the threaded stem 117 and is urged elastically by a spring 133 such as to maintain the nose 115 under elastic pressure with respect to the stem 117, thus preventing any vibration from resulting in unwanted rotation of the nose 115.

On the tip of the nose 115, there is advantageously provided a ball 140, which is accommodated in a substantially spherical seat 141, which ball 140 has the function of considerably reducing the friction between the nose 115 and rear groove 210 provided in the footwear.

Moreover, lubricating means are provided for the rotational movement of said ball 140, which means comprise a small pad 145 held pressed in by said piston 131 and containing some lubricant or similar element which is introduced into the seat 141 through a small channel 146.

In order to prevent the nose 115 from rotating incidentally, instead of the means just described, a machined portion 150 may be provided on the side surface of the nose, inside the seat 113, said machined portion being engaged by a small ball 151 which is urged elastically by a spring 152.

Naturally, other means can also be provided, e.g. an O-ring could be simply provided between the nose 115 and seat 113.

Again, the rod-like element 104 is held in contact with the rear region of the skier's leg by a gas spring 160 which has a cylinder 161 secured in a seat provided in a shaped block **161*a*, affixed to the rod-like element 104, and having a piston 162 the rod whereof has one end seated in a notch or hollow 163 provided in a crosspin 164 for connection to the body 111**.

Figures 15, 16, 19, 24, 25:
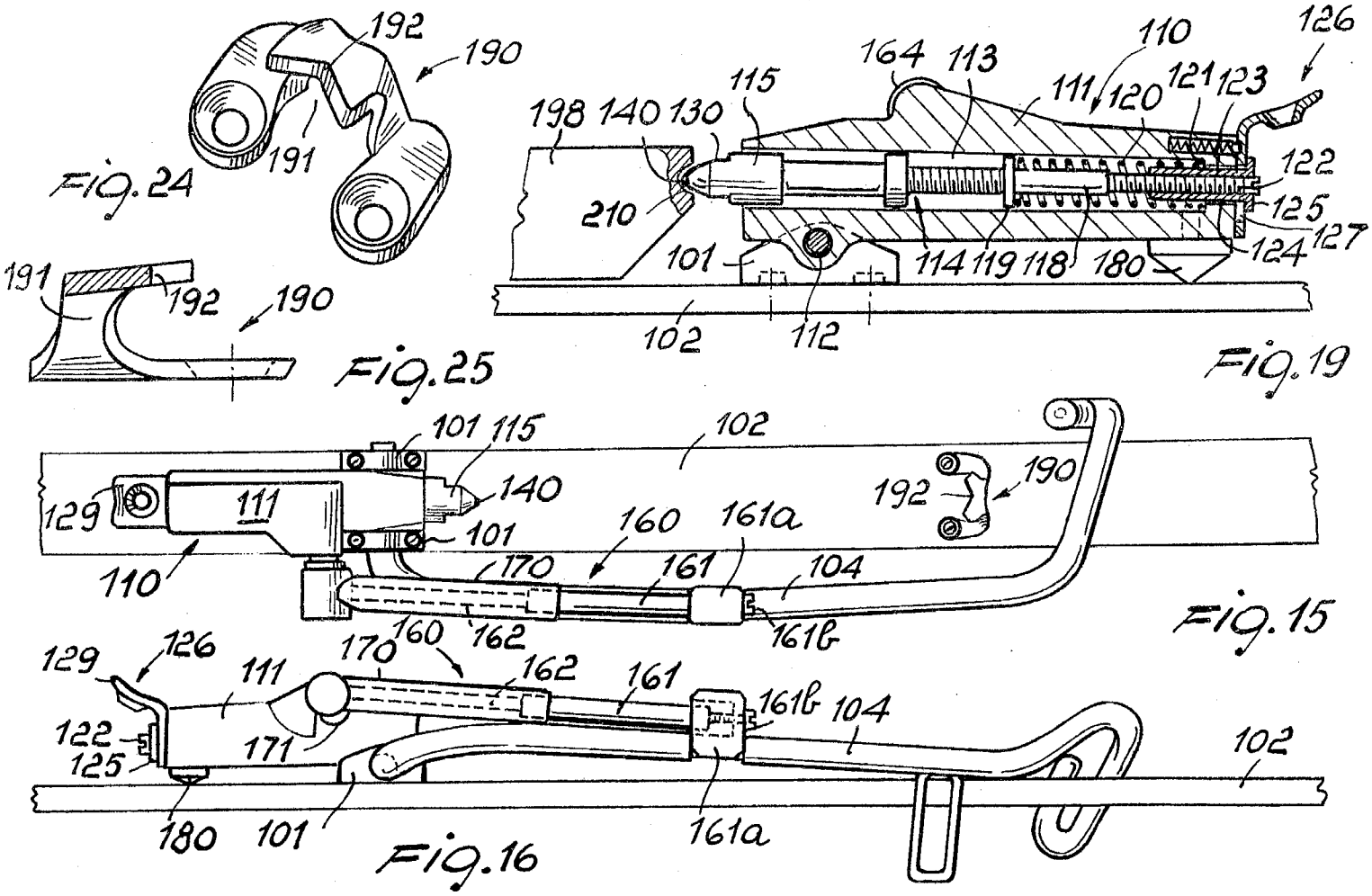
FIG. 15 is a plan view of a second embodiment of this ski binding structure.
FIG. 16 is a side elevation view of the ski binding structure of FIG. 15.
FIG. 19 is a longitudinal section of the rear latching body of that same binding structure.
FIG. 24 shows a variation of the front latching means, in perspective.
FIG. 25 is a midsectional view of those same front latching means.
Figure 17:
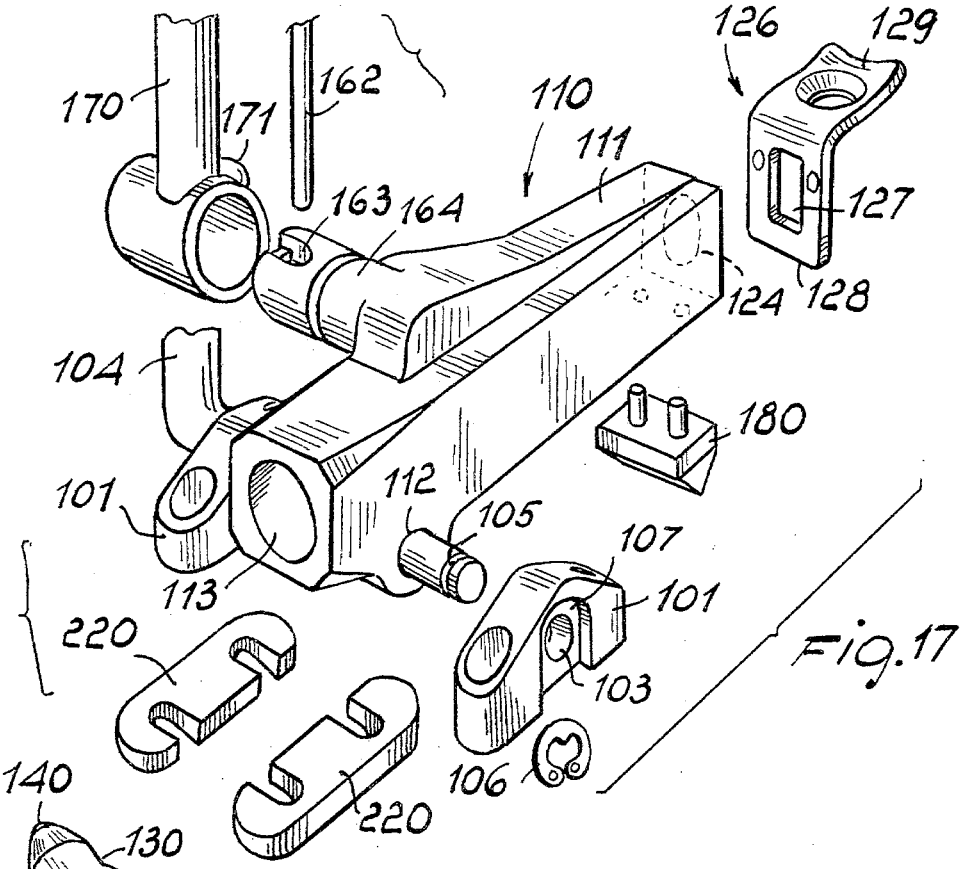
FIG. 17 is an exploded view of the rear latching body of the binding of FIGS. 15 and 16.
Figure 18:
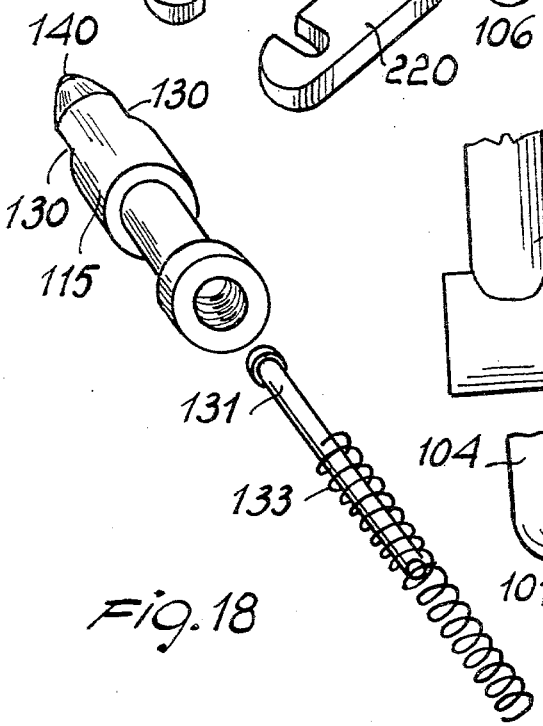
FIG. 18 is an exploded perspective view of some components of a pressure element of the binding of FIGS. 15–17.
Figure 20:
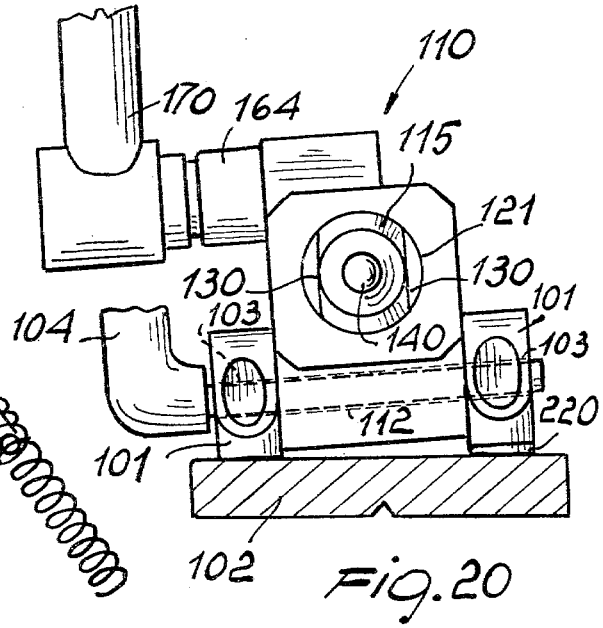
FIG. 20 is a front view, as taken from the ski front portion, of that same rear latching body.
Figure 21:
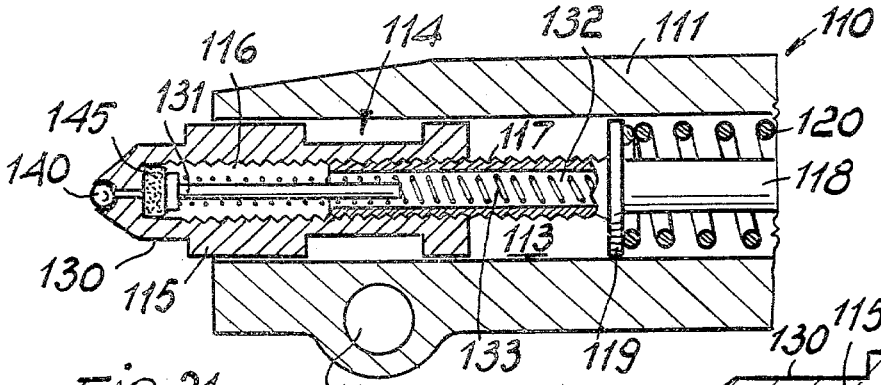
FIG. 21 is a sectional, enlarged scale, view of the front portion of the pressure element of said rear latching body.
Figure 23:
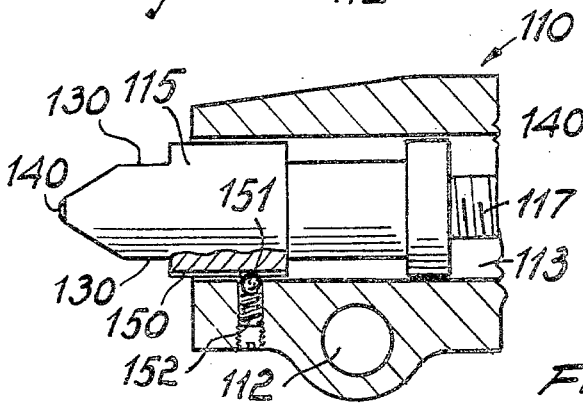
FIG. 23 illustrates a further embodiment of the front portion of the tip or toe termination.
Figure 22:
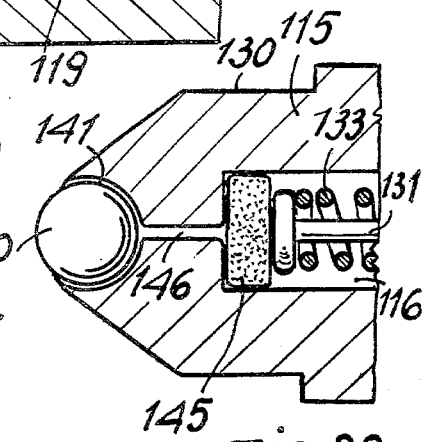
FIG. 22 is an enlarged scale detail view of the lubrication provided for the tip of the pressure element of the binding of FIGS. 15–21.
Figure 27:
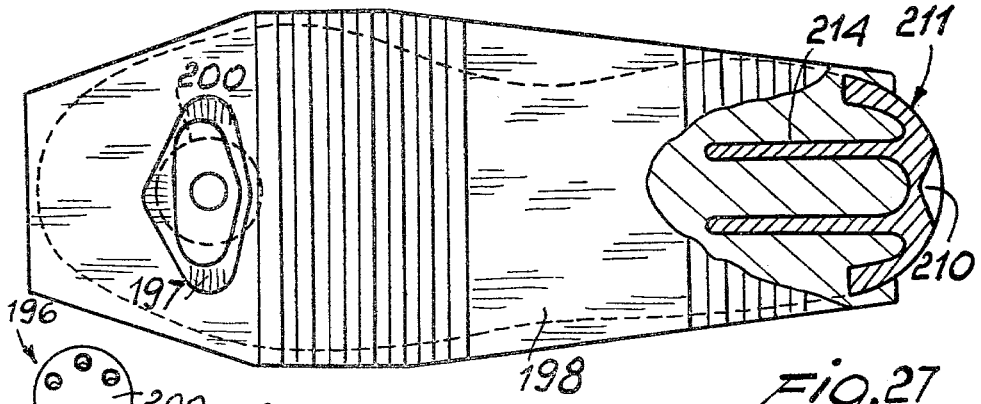
FIG. 27 is a plan, partly cut away, view of that same footwear sole.
Figure 26:
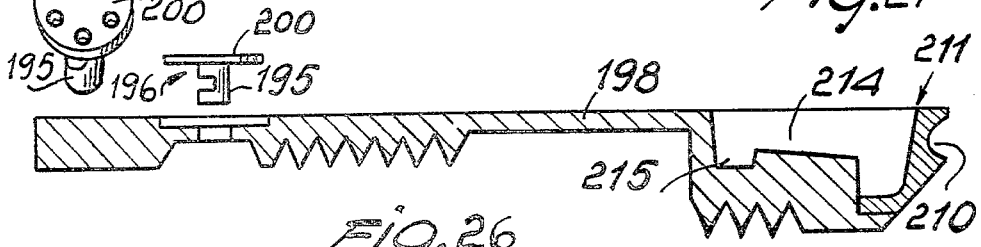
FIG. 26 shows schematically in section and partly in exploded view, a variation of the footwear sole as intended for use with the binding of FIGS. 15–25.

Thus, the assembly of the gas spring 160 is greatly simplified, since an elongated seat is provided in the block **161*a* allowing, during the assembly stage, the cylinder 161 to be inserted toward the right in FIGS. 15 and 16, past the normal position, while a screw 161*b*, when turned in, allows the gas spring 160** to be locked in its normal operating position.

Also provided is a sleeve, indicated at 170, which covers and protects the cited crosspin 164 and the area spanned by the piston 162 and defines laterally an enlargement 171 which, as it engages with the rod-like element 104, acts as a travel limiting element for the rotation of the rod-like element.

As already mentioned in the foregoing, the cited body or rear block 111 is supported by the rod-like element 104, and specifically by the lower end thereof, and bears on the ski 102 at its rear end. At the bearing point on the ski, an elastic block 180 is provided, having a substantially pyramid-like configuration with the apex facing the ski, which serves a dual function: firstly, the function of an icebreaking element to remove any snow or ice formations from the ski, and secondly, the function of imparting a certain spring action, albeit a very limited one, to the block 111, which allows an improved absorption of the stresses and loads imposed on the block itself.

The front latching means are substantially similar to those in the embodiment of FIGS. 1–15, and have a shaped plate 190 which can be affixed directly to the ski by means of screws and defines, about a front channel 191, a front latching seat or socket 192 of substantially V-like shape, similarly to the plate 24. The seat 192 receives the shank 195 of a peg 196 provided in a recess or notch 197 defined in the sole 198 of the footwear, at the foot toe end. The peg 196 is supported by a perforated plate 200 which is embedded in the sole; the holes through the perforated plate 200 have the very important function of facilitating the connection of the plate to the sole, to prevent the plate itself from sliding out; in practice, said holes are filled with rubber during the rubber casting step, such that there are formed plural bridging sections which firmly capture the perforated plate to prevent the front peg 196 from releasing itself.

The cited sole is formed on the rear with a rear latching groove or notch 210, which is provided in an insert 211 adapted for insertion in the heel portion of the sole. The cited rear latching notch or groove has a pair of inclines enabling release in a sideward direction, and a pair of inclines allowing release in an upward direction.

To facilitate the anchoring of the cited insert in the footwear sole, as well as to favor adherence of the sole to the footwear, the cited insert is provided with a rear region having a chamfer for facilitating insertion in the binding, and defines at the front ribs or ridges 214 which are terminated in an enlarged lug 215 performing the function of preventing the insert from sliding rearwardly out, the ribs occupying at the top a reduced area and increasing the area of adhesion of the sole to the bottom of the footwear. Obviously, the insert 211 may have a different shape, e.g. such that it can be inserted from the rear of the footwear, or may be directly vulcanized to the sole of the footwear.

Advantageously, shimming blocks, as indicated at 220, may be provided which would be mounted under one of said supports 101 to vary the inclination of the rod-like element 104 from the vertical.

In fact, it has been ascertained that for an improved fit to the pattern of a skier's leg, an outward inclination of approximately 3 degrees and 30 minutes is a convenient one. Of course, by changing the shimming blocks with other ones of different thickness, it will be possible to vary this inclination to fit the pattern of the user's leg, such that the ski is always caused to rest flat on the snow surface in normal operation conditions.

The use and operation of the binding structure of FIGS. 15–27 are similar to those already discussed for the embodiment of FIGS. 1–14.

By connecting the rear latching body 110 in an articulated manner to the rod-like element 104 about the same fixed axis 112, the advantage is secured of better discharging the loads applied to the ski.

The fact is underlined that it is more than a simple matter of kinematic reversal, but a very important variation instead, because the material wherefrom the block is formed is not subjected to excessive stresses which might otherwise result in failure of the block fastening screws.

Moreover, the articulated latching body is enabled to follow the ski flexing movements, while retaining the connection to the footwear. By providing two spaced apart supports for the rod-like element 104, one is enabled, through the cited shimming blocks 220, to change the inclination of the rod-like element from the vertical, thereby adaptation to any requirement of the user is ensured.

The ball 140 on the tip of the nose 115, which ball virtually removes any relative friction between the nose 115 and rear groove or notch 210, is effective to avoid jamming or blocking during the releasing stage, with attendant obviously increased safety for the user.

It will be apparent from the foregoing that the invention achieves its objects, and in particular the fact is emphasized that in this case, as well as in the cited prior patents by the same Applicant, it becomes possible to utilize a soft type of footwear, by virtue of the protection of the leg-foot articulation being provided by the rod-like element 1, 104, which is largely a rigid member capable of ensuring both an adequate degree of protection for the limb and transversal guiding for the ski while in use.

It should be noted, moreover, that no intermediate element or plate is provided between the ski surface and the skier's footwear, which considerably reduces the overall height of the binding structure.

Furthermore, by providing the dampened spring 10,160, the forward push exerted on the rod-like element 1,104 is made a gradual one which creates no inconvenience for the user in the event that he/she, inadvertedly, after raising the rod-like element 1,104, allows it to drop, and possibly hurt his/her hands, etc., because the spring, while providing a constant and gradual forward push, is self-dampening and can be replaced with a spring plus dampener.

The ski binding structure described hereinabove is susceptible to numerous modifications within the instant inventive concept as defined in the appended claims. Thus, for example, the bushing 62,122 could be held non-pivotally in the angle plate 70,126 and be actuated directly by the plate itself, in turn made of a shaped block of plastics held against the casing 51,111.

I claim:

1. A ski binding structure comprising a front latching means and a rear latching means for removably securing a skier's footwear to a ski, said front latching means comprising a front latching body fixed to said ski and said rear latching means comprising a rear latching body connected to said ski, a substantially rigid rod-like element having one end pivotally connected to said rear latching body for rotation about an axis substantially parallel to an upper ski surface and substantially perpendicular to a ski longitudinal extension, said rod-like element having another end shaped for engaging a skier's leg at a middle portion thereof, resilient means arranged between said rod-like element and said rear latching body for maintaining said rod-like element in contact with the skier's leg, wherein said front latching means further comprises a recess in a sole of said skier's footwear in a front sole portion and a peg in said recess, said front latching body and said peg being shaped for removable mutual engagement, and wherein said rear latching means further comprises a rear groove defined at a rear portion of said skier's footwear and a plunger housed in said rear latching body and extending towards said front latching means and resiliently and detachably engaging said rear groove, said rear groove and said plunger being arranged such as to maintain said skier's footwear slightly raised from the ski under normal rest conditions.

2. A ski binding structure as claimed in claim 1, wherein said plunger is inclined in a direction providing a force against said skier's footwear having a component acting against a weight force of the skier.

3. A ski binding structure as claimed in claim 1, wherein said front latching body has a height that is greater than the depth of said recess such that when said front latching body and said peg mutually engage each other said front sole portion is spaced from said ski.

4. A ski binding structure as claimed in claim 1, wherein said rear latching body has a front portion next to said skier's footwear and pivotally connected to a pair of supports shaped for rigid connection to said ski, said rear latching body being pivotable about an axis substantially parallel to said upper ski surface and substantially perpendicular to said ski longitudinal extension.

5. A ski binding structure as claimed in claim 4, wherein said rear latching body has a rear portion having a substantially pyramid-like configuration for resting on said ski.

6. A ski binding structure as claimed in claim 4, further comprising shimming blocks of different thickness for arrangement between said supports and said upper ski surface for varying the inclination of the pivoting plane of said rod-like element.

7. A ski binding structure as claimed in claim 1, wherein said rear latching body has a front portion next to said skier's footwear and pivotally connected to a pair of supports shaped for rigid connection to said ski, said rear latching body being pivotable about an axis coincident with said axis about which said rod-like element is pivotable.

8. A ski binding structure as claimed in claim 1, wherein said resilient means comprise a gas spring arranged between said rod-like element and said rear latching body.

9. A ski binding structure as claimed in claim 1, wherein said another end of said rod-like element is bent forward with respect to the ski binding, and wherein said rod-like element is pivotable into a position substantially parallel to said ski such that said another end becomes arranged below said ski for acting as a ski stopper.

10. A ski binding structure as claimed in claim 1, wherein said plunger comprises a stem having a front threaded portion and a rear threaded portion, a rear bushing threadably engaging said rear threaded portion and unrotatably housed in said rear latching body, an annular enlargement on said stem between said front and said rear threaded portion, a spring between said annular enlargement and said rear latching body for urging said stem forwards, and a front pressure element projecting from said rear latching body and threadably engaging said front threaded portion of said stem such as to vary at will the axial position of said pressure element with respect to said stem without varying the force of said spring.

* * * * *